United States Patent [19]

Andreasson

[11] Patent Number: 4,562,811

[45] Date of Patent: Jan. 7, 1986

[54] IGNITION CIRCUIT

[75] Inventor: Bo C. Andreasson, Gothenburg, Sweden

[73] Assignee: EMAB Electrolux Motor Aktiebolag, Huskvarna, Sweden

[21] Appl. No.: 540,343

[22] Filed: Oct. 11, 1983

[30] Foreign Application Priority Data

Oct. 18, 1982 [SE] Sweden ..... 8205901

[51] Int. Cl.[4] ..... F02P 5/04

[52] U.S. Cl. ..... 123/416; 123/149 C; 123/417; 123/618

[58] Field of Search ..... 123/416, 417, 418, 149 C, 123/600, 618

[56] References Cited

U.S. PATENT DOCUMENTS 3,878,824 4/1975 Haubner et al. ..... 123/149 C
4,133,323 1/1979 Adler ..... 123/416
4,175,506 11/1979 Sakamoto et al. ..... 123/416
4,378,769 4/1983 Haubner et al. ..... 123/416

*Primary Examiner*—Andrew M. Dolinar
*Attorney, Agent, or Firm*—Alfred E. Miller

[57] ABSTRACT

An electronic circuit device for ignition pulses for an i.c. engine having a two- or three pole magnetic system generating positive and negative pulses. One of the pulses is used for ignition energy and the other for power supply of electronic equipment. As a reference point for ignition advance calculation is the peak of said power supplying pulses used. An oscillator (36) supplies a pulse frequency many times higher than the r.p.m. of the engine. A peak detector (14) and said oscillator are connected to a pulse counter (39) which after a predetermined number of pulses from the reference point releases a trigger pulse for the ignition energy. A logic unit (12) sets the counter on the predetermined number in dependence of the r.p.m. of the engine.

6 Claims, 6 Drawing Figures

4013
41
4081
40
4040
39
4040
37
4046
36
4013
35
42
38
28
29
21
23
26
22
27
16
25
31
32
34
33
$U_B$
$U_K$
$U_T$
CL
Q
R

IGNITION CIRCUIT

The present invention relates to an ignition circuit for i.c. engines having a magnet ignition system in which an ignition generator generates a primary voltage in form of pulses.

It is known in the art of ignition circuits to provide a special triggering circuit to release the spark energy with a predetermined advance before the top dead position of the piston. Such a circuit can be a coil which is closely passed by the permanent magnet positioned in the flywheel of the engine and included in the ignition generator, whereby a trigger pulse is generated in the coil when the magnet passes by. In recently developed ignition circuits the triggering coil has been excluded and replaced by a control circuit which generates the trigger pulse by means of the ignition energy pulse. In connection with such a development an electronic memory has been created for ignition timing characteristics adapted to the discussed engine from which memory the control circuit supplying the trigger pulse obtains the magnitudes of advance in the ignition in dependence of the r.p.m. of the engine.

The present invention provides an ignition system having simplifications and improvements in some respects in relation to known systems. Since a two- or three pole magnetic system generates both positive and negative pulses it is an improvement to use the one kind of these pulses for ignition energy and the other kind for feeding the control circuits. In order to make the ignition control accurate a well defined reference point is needed, and such a point is the top of the pulses used for this feeding.

The use of these pulses for the electronic control means that the other kind of pulses remains intact and can wholly be used for making ignition energy. The said magnitudes of advance are expressed in a pulse frequency which is a multiple of the r.p.m. of the engine. Since the pulse frequency is associated with the said reference point the number of pulses passing after the reference point correspond to an angle of rotation of the engine shaft. When a number of pulses given from the memory coincide with passing pulses (in a pulse counter) the time for ignition is due which is realized as a trigger pulse from the control unit.

Figure 5:
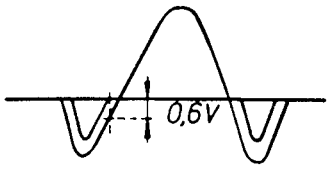

A couple of embodiments of the device according to the invention are described in the following with reference to the attached drawings which show in FIG. 1 a block diagram of the device, FIG. 2 a wiring diagram of the associated ignition energy circuit and the voltage supply, FIG. 3 a part of a voltage curve from the ignition generator, FIG. 4 an example of a wiring diagram of the system, FIG. 5 a variation of a voltage curve from the ignition generator, FIG. 6 a variation of the wiring diagram of the system.

Figure 1:
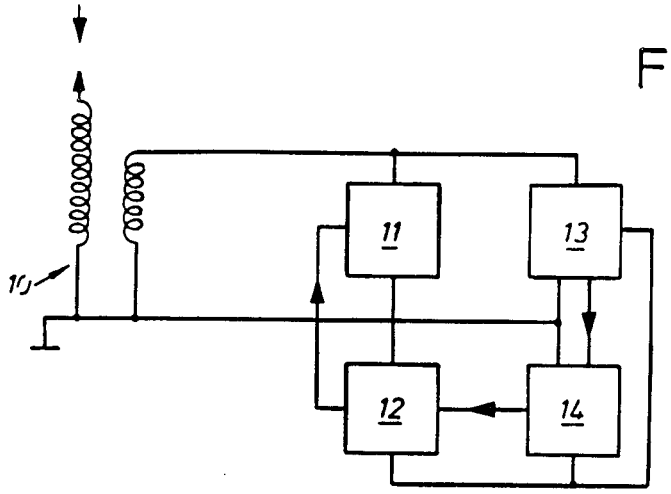
Figure 2:
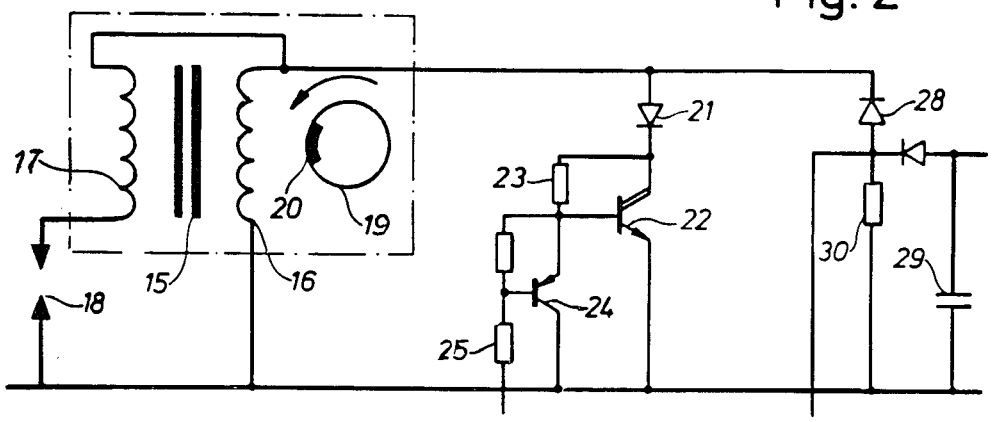

The block diagram shown in FIG. 1 illustrates five units interconnected by wiring. An ignition coil 10 has in the usual way a primary and a secondary winding, the primary connected to an electronic ignition energy unit 11 which receives pulses on a wire from a logic unit 12. The control circuits are supplied from a voltage supply 13 which also supplies a peak voltage detector 14. The several units can be modified but for limitation a few preferred simple and reliable embodiments will be described in the following. The ignition coil, the ignition energy unit, and the supply are shown in detail in FIG. 2. The ignition coil has an iron core 15 with windings 16, 17 of which the latter supplies a high voltage and the release of a spark in a spark plug 18. The iron core is positioned close to the flywheel 19 of the engine provided with a magnet 20 which induces a voltage in the winding 16.

The components of the ignition energy circuit (FIG. 2) are those which usually are comprised in a transistor ignition system. A diode 21 passes the positive pulse of the induced voltage from the winding 16 which pulse passes a Darlington-transistor 22 which receives a control current through a resistor 23. A voltage makes a current through the winding and the ignition energy circuit, whereby a magnetic field is produced in the ignition coil. Another transistor 24 is initially non-conductive, since a base-resistor 25 does not yet forward a control current. This resistor is connected to the logic unit 12 which supplies a trigger pulse at the ignition time for the engine, when the transistor 24 starts conducting and the base current to the transistor 22 ceases. This breaks the current in the winding 16 which causes a certain decrease of the magnetic field which then induces the ignition voltage in the winding 17.

Figure 4:
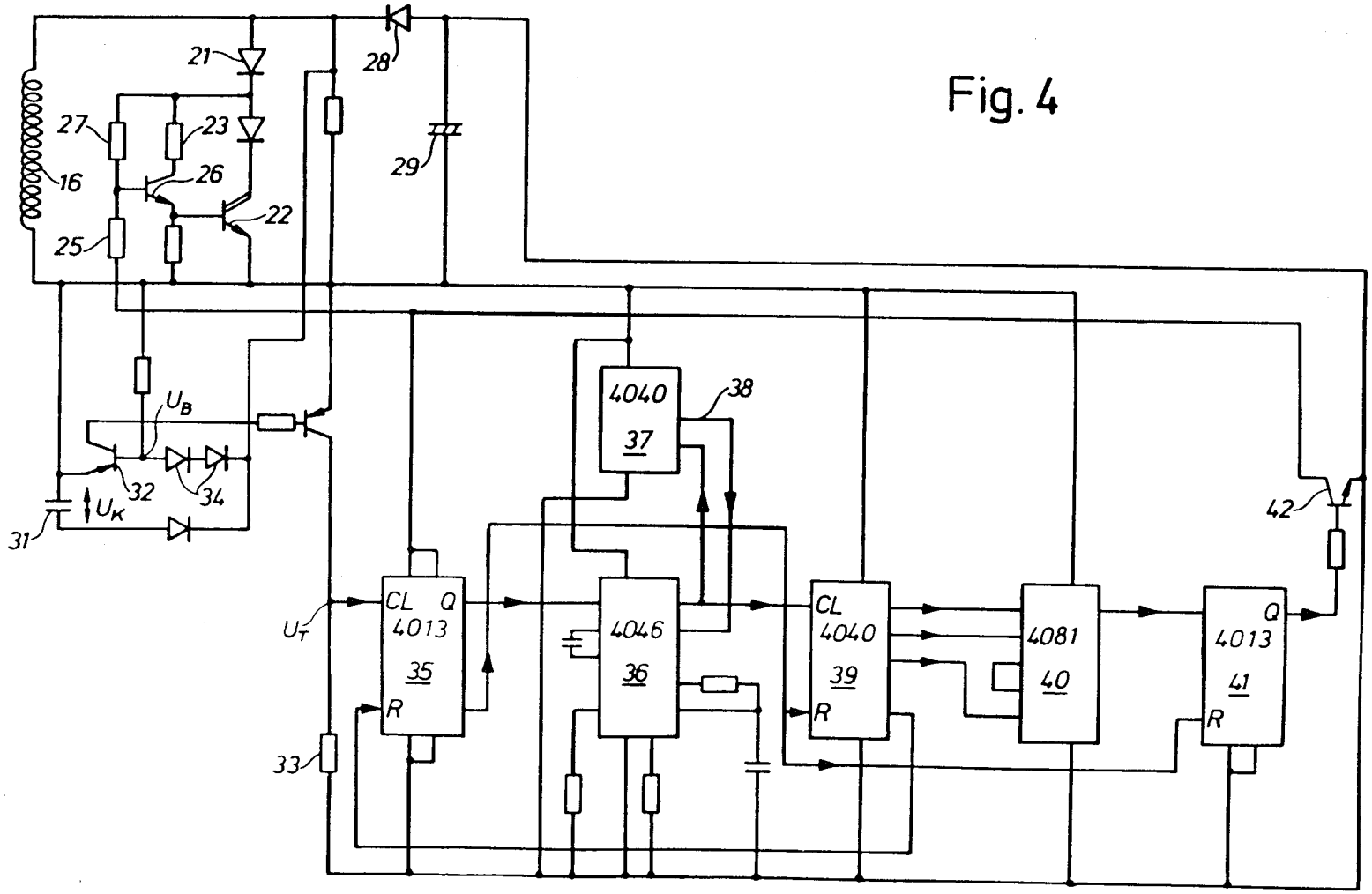

A variation of an ignition energy circuit is shown in FIG. 4 which is similar to the one above described. The base of the Darlington-transistor is, however, supplied by an NPN-transistor 26. The advantage of this design of the circit is that the only load is a resistor 27, when the circuit is broken and this resistor is very high-ohmic. Thanks to this the voltages will be higher and the spark better.

The current supply to the control circuits is effected by a supply unit 13 as a rectifier 28 lets the negative parts of the generator voltage through and keeps a capacitor 29 charged. A resistor 30 shunting the capacitor determines the maximum allowable DC-voltage. Due to the high r.p.m. of the engine the negative pulses of the generator voltage have so high magnitude that a non-controlled spark in the spark plug can occur. This spark has the drawback that it causes high radio disturbances and should therefore be depressed. The resistor 30 restricts the risk for such disturbances.

Figure 3:
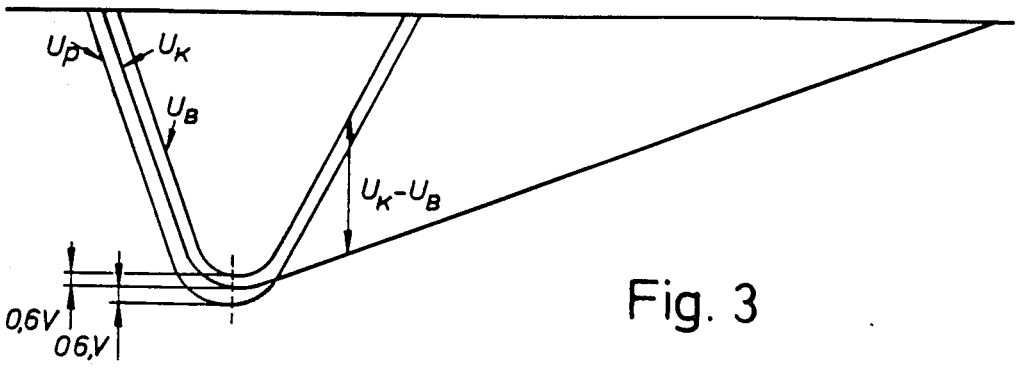

The negative voltage pulse $U_p$ shown in FIG. 3 is the initial part of the voltage curve supplied by the ignition generator each time the magnet passes the iron core. This pulse is fed on a wire to the peak voltage detector 14 and charges the capacitor 31 (FIG. 4) along the curve $U_K$ which runs parallel to the curve $U_p$. Another voltage $U_B$ (base voltage) is parallel but somewhat displaced and forms after the top a voltage difference $U_B-U_K$, where $U_K$ is the cpacitor voltage which drops along a discharging curve.

The peak detector which senses the first negative amplitude of the voltage curve has a diagram according to FIG. 4. Up to the negative peak (FIG. 3) the transistor 32 is non-conductive as the voltage $U_B-U_K$ corresponds to the voltage of the transistor 32 and thus makes no control current. After the peak $U_B-U_K$ increases so that the transistor is made conductive. Another transistor having control current from the first one starts conducting and a voltage $U_T$ is created in the resistor 33. Diodes 34 are provided in order to compensate the voltage drop in the curves $U_B$, $U_K$ in relation to $U_p$. If these diodes were not there the signal $U_T$ should occur 1.2 V (0.6+0.6) after the peak. All components in the detector have the same temperature characteristic so that the circuit will be automatically temperature compensated, i.e. it will maintain the same function at all temperatures. The said negative peak of the curve is, moreover, insensitive to deviations in pole distance and magnetic flux. A variation of the detector making a reference point near below zero of the negative half-wave is shown in FIG. 6 and the voltage curve and reference point in FIG. 5. The ignition energy unit can also be carried out as shown in FIG. 2.

simplified diagram of the logic unit is shown in FIG. 4 in which the simplification is realized in that several functions are carried out by standard modules by CMOS-technics. The $U_T$-signal reaches the logic unit through a module 4013 which is a logic D-flip-flop and is used as input and logic control circuit 35. Such a module is triggered by a positive voltage step (flank), in the diagram according to FIG. 4 the pulse from the peak detector enters in the input CL. Its output Q supplies after triggering a continuous signal until the molule is reset which is made by a pulse on the input R when an ignition curve according to FIG. 3 has passed the energy circuit.

A pulse generator 36 with an adjustable frequency is comprised of a module No. 4046 which is controlled by the control circuit 35 and a counter 37 which in this example is a module 4040. The frequency of the signal of the output Q is equal to or proportional to the r.p.m. of the engine, and the output 38 of the counter supplies a binary number which in the generator is used as a factor for multiplication of the frequency from the control circuit 35. The pulse frequency out of the generator is thus a product of the said signal frequency and binary number.

A second counter 39 comprised of another module 4040 is a receiver of said pulse frequency which enters the counter on the input CL. It also receives a control signal from the control circuit 35 on the input R, whereupon counting of the pulses on CL starts when the signal from the control circuit appears, and zerosetting of the counter takes place when the signal ceases. The output of the counter supplies a binary number corresponding to the number of the pulses.

An AND-circuit 40 comprise off a module 4081 receives the said binary number and decodes it. This occurs when the binary number has reached a predetermined value so that the terms of the AND-circuit are satisfied, whereby a signal appears on its output.

The device has, finally, a flip-fop 41 comprised of another module 4013 controlled by the signal from the AND-circuit so that its output Q supplies a continuous signal until it is reset which is made by a pulse on the input R from the circuit 35. The output signal is passed to a transistor amplifier 42 which is used for controlling the effect transistor in the energy circuit. Simultaneouslyas the AND-circuit supplies its output this continuous signal appears and controls the transistor amplifier 42 to be conductive whereby the control current to the effect transistor passes by and breaking and therewith following ignition take place.

Figure 6:
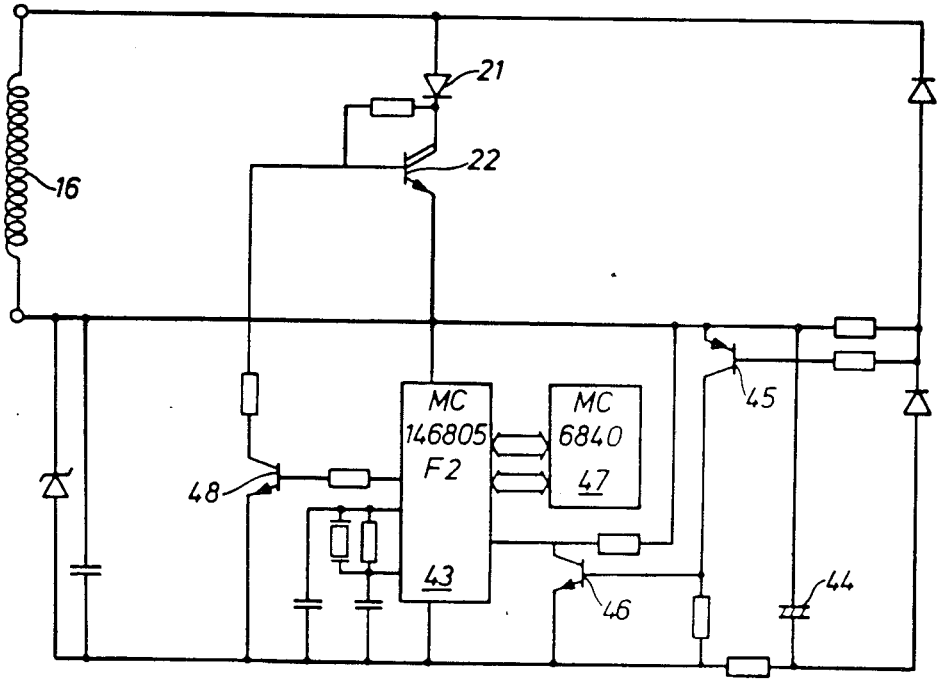

A simplified diagram of an ignition system provided with a micro-computor 43 is shown in FIG. 6 including functions which are i.a. shown in FIG. 4. The current supply to the micro-computor is effected by means of the negative half-waves which keep a capacitor 44 charged to working voltage. A transistor amplifier 45, 46 is used for feeding pulses at the time of the reference point on the voltage curve (FIG. 5) which point in this case is positioned 0.6 V before zero on the ascending part of the curve. The pulse is fed to the micro-computor as a start signal of a procedure similar to the one following on the aforesaid triggering signal in the device according to FIG. 4. However, the system is now completed with an ignition advancing calculation so that a suitable advance in ignition at any r.p.m. of the engine takes place. The micro-computor is provided with a static memory which by a plurality of current r.p.m. states a number of pulses in a pulse sequence similar to the one coming out of the counter 39 (FIG. 4) which number of pulses is represented by a binary number which is supplied to a programmable timer 47 in which there is an equivalent to the AND-circuit 40 which in its case is programmed by said binary number so that the AND-circuit always is adjusted on a number corresponding to a suitable advance ignition at the current r.p.m. A counter in the micro-computor is equivalent to the counter 39 and when it has counted pulses up to a number expressed in a binary number corresponding to the present adjustment of the AND-circuit the micro-computor supplies an output singal to transistor amplifier 48 which then makes the control current pass by the Darlington-transistor so that the primary circuit is broken and a spark released. On the drawing notifications are made about an available suitable micro-computor and also a suitable programmable timer.

I claim:

1. An electronic ignition circuit device for i.c. engines having a magnetic ignition system for generating pulses of ignition energy, an ignition coil with a primary winding connected to an ignition switch switchable by triggering and a secondary winding connected to a spark plug, and a logic unit supplied by the magnetic system and provided with a detector responsive to said pulses of ignition energy for establishing a reference point for every pulse, the improvement wherein the logic unit includes an oscillator means for generating pulses at a frequency which is a multiple of the frequency of said pulses of ignition energy, a pulse counter connected to the oscillator means and logic circuits which upon the occurence of said reference point starts the counter for counting the pulses and a decoder connected to the counter and adjustable to a critical number, said decoder being connected to output a signal for controlling said ignition switch when the counter counting said pulses reaches the critical number, said ignition energy having first and second half waves, and the detector establishing the reference point at the top of the first half wave of the generated energy of every spark.

2. An ignition circuit device according to claim 1, wherein an arrangement for current supply of the logical unit comprises a capacitor and at least a rectifier connected to a magnet winding to admit said half-wave to the capacitor.

3. An ignition circuit device according to claim 2, wherein said first half-wave of the energy is used for said current supply and a second half-wave for the creation of spark energy.

4. An ignition circuit device according to claim 1, wherein the logical unit comprises a micro-computor provided with a static memory having an input receiving a code representing the r.p.m. of the engine and storing information on ignition advance as a function of the r.p.m., said information transferable to said decoder which therewith is adjusted on said critical number in dependence of the r.p.m.

5. An ignition circuit device according to claim 1, wherein the logical unit comprises a micro-computor provided with a static memory having an input receiving a code representing the r.p.m. of the engine and storing information on ignition advance as a function of the r.p.m., said information decoded in said decoder which is incorporated in the micro-computer and therewith is adjusted on the said critical number in dependence of the r.p.m.

6. In an ignition system, for an internal combustion engine, having an ignition coil, means inducing pulses in said coil at the r.p.m. of said engine, ignition switch means connected to enable current flow in said coil, and control means connected to control said switch means to interrupt said current flow; the improvement wherein said control means comprises oscillator means, means controlling the frequency of said oscillator means to be proportional to and greater than said r.p.m. counter means connected to count the output of said oscillator means, means responsive to said pulses for initiating counting cycles in said counter means, and means responsive to a given count in said counter means for interrupting said switch means, said means controlling the frequency of said oscillator means comprising means responsive to said pulses for controlling said oscillator means, said means responsive to said pulses comprising peak detector means for detecting the peaks of said pulses.

* * * * *